US006398069B1

(12) United States Patent
O'Brien

(10) Patent No.: US 6,398,069 B1
(45) Date of Patent: Jun. 4, 2002

(54) LABEL APPLICATOR APPARATUS

(75) Inventor: Peter James O'Brien, Abbotsford (AU)

(73) Assignee: Ilme Louise Kukainis (AU)

( * ) Notice: Subject to any disclaimer, the term of this patent is extended or adjusted under 35 U.S.C. 154(b) by 0 days.

(21) Appl. No.: 09/849,942

(22) Filed: May 4, 2001

Related U.S. Application Data

(63) Continuation of application No. PCT/AU99/00939, filed on Oct. 29, 1999.

(30) Foreign Application Priority Data

Nov. 4, 1998 (AU) ..... PP6913

(51) Int. Cl.[7] ..... B65H 5/28
(52) U.S. Cl. ..... 221/73; 221/259
(58) Field of Search ..... 221/71, 72, 73, 221/259, 210; 156/443, 541, 542, 584, DIG. 33

(56) References Cited

U.S. PATENT DOCUMENTS 5,158,642 A * 10/1992 Koike ..... 221/73
5,209,374 A 5/1993 Seidl-Lichthardt ..... 221/73

FOREIGN PATENT DOCUMENTS

CA 2190543 5/1998 ..... B65C/9/30
DE 2 008 187 9/1971
EP 0 665 165 A1 8/1995 ..... B65C/9/18

* cited by examiner

*Primary Examiner*—Kenneth W. Noland
(74) *Attorney, Agent, or Firm*—Schwegman, Lundberg, Woessner & Kluth, P.A.

(57) ABSTRACT

Label applicator apparatus for applying a self-adhesive label to a surface which is movable relative to the apparatus. The label is carried on an elongate backing web having a plurality of labels adhered to one side thereof in longitudinally spaced relationship. The apparatus includes an edge over which the web is drawn whereby, when a force is applied along the web which exceeds a peeling threshold, the web is peeled away from the label and the label is dispensed at the edge. The apparatus includes pressing means located a set distance from the edge for pressing the label against the surface as it is dispensed, thereby adhering the label to the surface, and means for applying a peeling force which is greater than the peeling threshold during dispensing of at least an initial portion of the label which spans the set distance to initiate dispensing of the label. The peeling force is operative during dispensing of the initial portion of he label and is inoperative during dispensing of the initial portion of the label and is inoperative during dispensing of a final portion of the label, wherein when the peeling force is inoperative, dispensing is continued due to an additional force being exerted along the web by a portion of the label which is adhered to the surface.

17 Claims, 3 Drawing Sheets

LABEL APPLICATOR APPARATUS

This application is a continuation under 35 U.S.C. 111(a) of PCT/AU99/00939, filed Oct. 29, 1999 and published as WO 00/26093 on May 11, 2000, which claims priority from Australian Application No. PP 6913, filed Nov. 4, 1998, both of which applications are incorporated herein by reference.

The present invention relates generally to label applicator apparatus. More particularly the invention relates to apparatus for applying to a surface self-adhesive labels of the type provided on an elongate backing web.

Various label applicators are known in the art for applying this type of label but each has its own problems. One significant problem which fails to be adequately addressed by known applicators is their inability to apply a single label to a surface.

Some known label applicators use mechanical indexing systems that pierce the backing web or engage registration holes manufactured into the web to feed a predetermined length of the web upon manual actuation of a trigger or the like. However, these applicators can only be used with labels of a predefined type or predefined length or range of lengths.

Other known label applicators rely on the operator to watch for the end of the label as it is being applied and to disengage the feed mechanism (by tilting the applicator for example) to prevent the next label on the web from being dispensed. These label applicators require a degree of skill on the part of the operator.

In both of these general types of known label applicators an external action or intervention is required to dispense and apply a single label to a surface. Industrial or high speed repetitive operation of such label applicators is therefore limited.

The present invention is directed to providing a label applicator which can dispense and apply to a surface a single self-adhesive label of indefinite length. It is also desirable for the label applicator to achieve this without external intervention, other than interaction between the applicator and the surface to which the label is to be applied.

The term "self-adhesive label" as used throughout the specification denotes a sheet of paper or other material having a layer of pressure sensitive adhesive applied to at least a part of its surface. One surface of the sheet may display image and/or text matter. Examples of such self-adhesive labels include product packaging labels, address labels, postage stamps, price stickers, etc.

According to one aspect of the present invention there is provided apparatus for applying a self-adhesive label to a surface which is movable relative to said apparatus, said label being carried on an elongate backing web having a plurality of labels adhered to one side thereof in longitudinally spaced relationship, said apparatus including:

an edge over which said web is drawn whereby, when a force is applied along said web which exceeds a peeling threshold, said web is peeled away from said label and said label is dispensed at said edge;

pressing means located a set distance from said edge for pressing said label against said surface as it is dispensed, thereby adhering said label to said surface; and means for applying a peeling force which is greater than said peeling threshold during dispensing of at least an initial portion of said label which spans said set distance to initiate dispensing of said label, said peeling force being operative during dispensing of said initial portion of said label and being inoperative during dispensing of a final portion of said label, wherein when said peeling force is inoperative, dispensing is continued due to an additional force being exerted along said web by a portion of said label which is adhered to said surface.

The peeling force may be a single force applied to the web or it may be a combination of several forces acting together. In either case, the resultant force on the web should be at least sufficient to exceed the peeling threshold to initiate dispensing of the label.

Preferably a means for applying a take-up force, which is below the peeling threshold, is provided during at least a part of the dispensing cycle for taking up the peeled backing web from the edge. The means for applying the peeling force may include the means for applying the take-up force. The take-up force may also form part of the peeling force.

According to a further aspect of the present invention there is provided apparatus for applying a self-adhesive label to a surface which is movable relative to said apparatus, said label being carried on an elongate backing web having a plurality of labels adhered to one side thereof in longitudinally spaced relationship, said apparatus including:

an edge over which said web is drawn whereby, when a force is applied along said web which exceeds a peeling threshold, said web is peeled away from said label and said label is dispensed at said edge;

pressing means located a set distance from said edge for pressing said label against said surface as it is dispensed, thereby adhering said label to said surface; and means for applying, in a first mode, a driving force and, in a second mode, a take-up force along said backing web, said driving force being greater than said peeling threshold to initiate dispensing of said label, said driving force being operative over at least an initial portion of said label which spans said set distance and being inoperative over a final portion of said label, said take-up force being below said peeling threshold and being sufficient to take up said peeled backing web from said edge, and wherein, during dispensing of said final portion of said label when said driving force is inoperative, movement relative to said apparatus of said surface and a portion of said label which is adhered thereto provides an additional force along said backing web, said take-up and additional forces together exceeding said peeling threshold to continue dispensing of said label.

In this embodiment the driving force and take-up force may both be applied to the peeled or waste portion of the backing web, leaving the edge at which the label is dispensed. In this way, each force may act to pull the web around the edge.

During dispensing of the final portion of the label, the additional force arising from the label itself being partially adhered to the surface may act to pull the web toward the dispensing edge. The additional force alone may be sufficient to exceed the peeling threshold or it may act in conjunction with the take-up force to exceed the peeling threshold. In either case, dispensing of the label may be continued.

According to a still further aspect of the present invention there is provided apparatus for applying a self-adhesive label to a surface which is movable relative to said apparatus, said label being carried on an elongate backing web having a plurality of labels adhered to one side thereof in longitudinally spaced relationship, said apparatus including:

an edge over which said web is drawn whereby, when a force is applied along said web which exceeds a peeling threshold, said web is peeled away from said label and said label is dispensed at said edge;

take-up means for taking up said peeled backing web from said edge, said take-up means being adapted to apply a take-up force to said web which is below said peeling threshold;

pressing means located a set distance from said edge for pressing said label against said surface as it is dispensed, thereby adhering said label to said surface; and means for applying a supplemental force along said backing web to supplement said take-up force, said take-up and supplemental forces together exceeding said peeling threshold to initiate dispensing of said label, said supplemental force being operative over at least an initial portion of said label which spans said set distance and being inoperative over a final portion of said label, and wherein, during dispensing of said final portion of said label when said supplemental force is inoperative, movement relative to said apparatus of said surface and a portion of said label which is adhered thereto provides an additional force along said backing web, said take-up and additional forces together exceeding said peeling threshold to continue dispensing of said label.

In this embodiment the take-up force may be present throughout a dispensing cycle and the supplemental force may be applied to initiate dispensing of the label. The take-up force may be applied to the peeled or waste portion of the backing web leaving the edge at which the label is dispensed. The take-up force may thus assist in pulling the web around the edge, but may not be sufficient by itself to dispense a label.

The supplemental force may be applied to a portion of the web approaching the dispensing edge. In one embodiment the supplemental force may be applied to a front face of the label being dispensed. In this way, the label and web may be pushed toward the dispensing edge, at least during dispensing of the initial portion of the label.

The label applicators of the invention may automatically apply a single label to the surface without external action or intervention. This is because the peeling force to overcome the peeling threshold, whether that be a single driving force or the combined action of a take-up force and a supplemental force, may be applied to the web for the initial portion of the label only and not the final portion. For the final portion, the label itself may provide the additional force on the web needed to complete the dispensing cycle. Upon completion of a dispensing cycle, when the label is fully separated from the backing web, there may no longer be sufficient force on the web to dispense the next label. The take-up force may then act on the web and that take-up force, being below the peeling threshold, may be insufficient to initiate dispensing of the next label.

A label applicator apparatus according to the present invention may be used for:

application of labels for a variety of purposes;

application of postage stamps when carried on a backing web;

application of price stickers;

application of any material that is carried on a backing web and can be removed therefrom by pulling the web around an edge, such as an edge of a peel plate.

Preferred embodiments of the present invention will now be described with reference to the accompanying drawings wherein.

Figure 1:
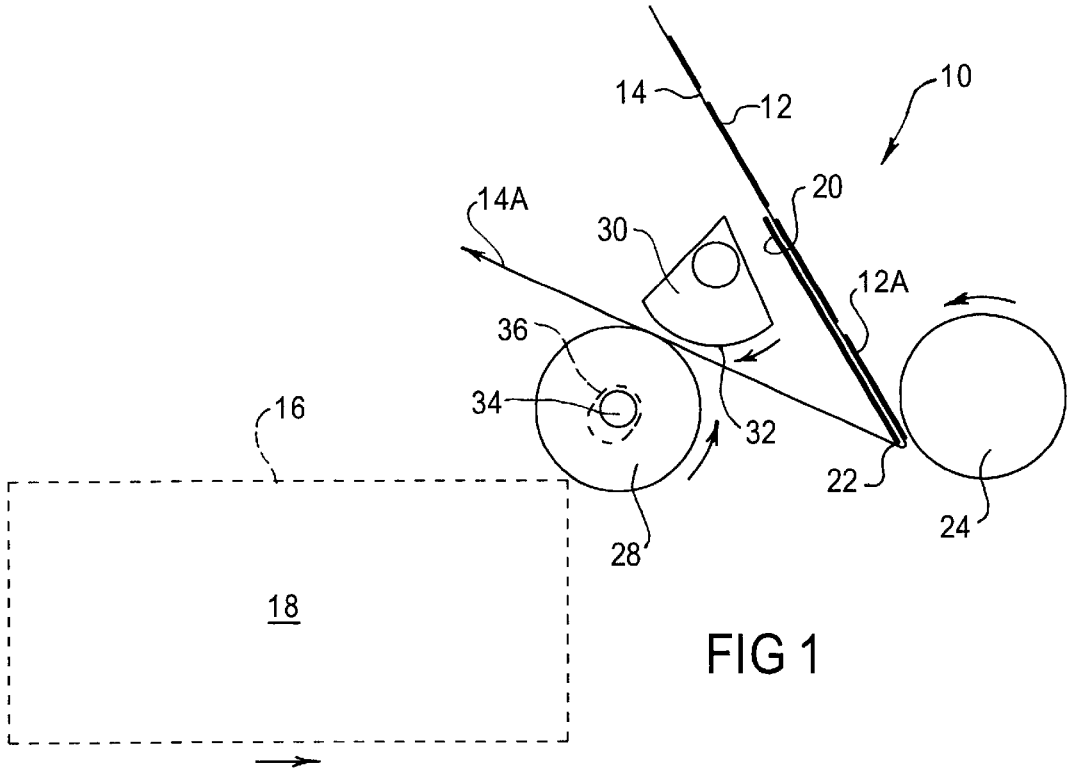
FIG. 1 shows a cross-sectional side view of a label applicator according to a first preferred embodiment of the invention, prior to commencement of a label application cycle.
Figure 2:
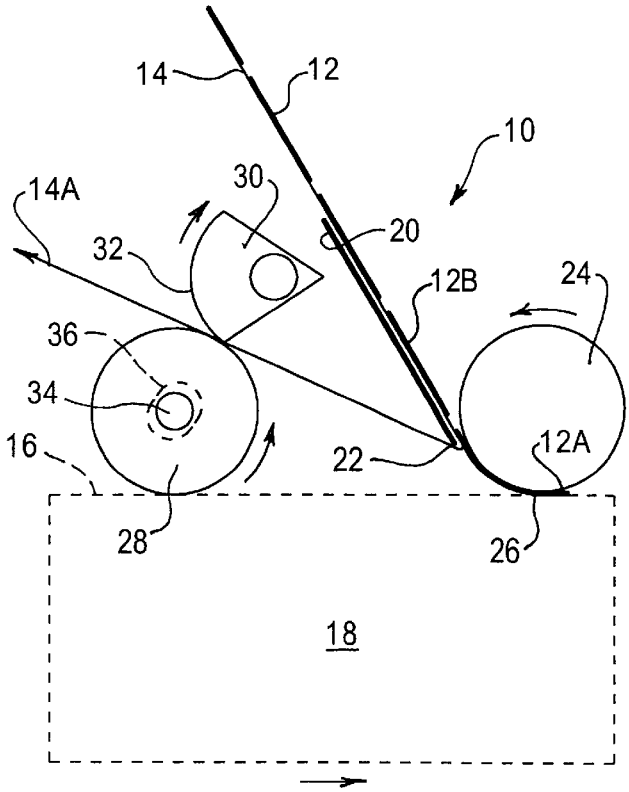
FIG. 2 shows a cross-sectional side view of the label applicator of FIG. 1 during the label application cycle.

Referring to the drawings, FIGS. 1 and 2 show cross-sectional side views of a first preferred embodiment of a label applicator 10 of the invention. FIG. 1 shows applicator 10 prior to commencement of a label application cycle and FIG. 2 shows applicator 10 during the label application cycle.

The applicator 10 is used to apply self adhesive labels 12 of the type provided on an elongate backing web 14 wherein labels 12 are carried on backing web 14 in longitudinally spaced relationship.

A label 12A is to be applied to a surface 16 of a product 18 which is being carried along a conveyor belt (not shown). FIGS. 1 and 2 depict product 18 moving from left to right below stationary applicator 10. However, an alternative arrangement is that product 18 is stationary and applicator 10 is moved from right to left (as viewed in FIGS. 1 and 2) across product 18. Applicator 10 may be used to apply a label 12A to any surface of product 18.

Applicator 10 includes a peel plate 20 having a lower edge 22 around which web 14 is drawn. When a force is applied along web 14 which exceeds a peeling threshold, label 12A is urged toward edge 22, a waste portion 14A of web 14 is peeled away from the back of label 12A and label 12A proceeds forward to be dispensed at edge 22 toward surface 16.

Located adjacent edge 22 is a pressing means in the form of a rub-down roller 24. Roller 24 can freely rotate about an axis which has a fixed position relative to peel plate 20 and its edge 22. In use, lowermost portion of rub-down roller 24 forms with surface 16 a pinch point 26 (refer FIG. 2) which serves to press label 12A against surface 16 to thereby adhere label 12A to surface 16. Pinch point 26 is located a set distance from edge 22, as will be explained below.

A drive mechanism provides a peeling force along web 14 necessary to initiate dispensing of label 12A from edge 22. The drive mechanism includes a drive roller 28 and an opposing roller segment 30 having a limited arc of contact 32. The length of the arc of contact 32 is equal to or greater than the set distance mentioned above and the reason for this will be explained below. The waste portion 14A of web 14 passes between drive roller 28 and opposing roller segment 30.

Drive roller 28 has projecting from each of its ends an axle member 34 on which it rotates. Axle members 34 are supported within elongate slots 36 provided within a frame or structure of applicator 10. Slots 36 are thus in a fixed position relative to peel plate 20, and axle members 34 can slide within slots 36 to enable drive roller 28 to move toward and away from opposing roller segment 30. Drive roller 28 is spring biased towards the lower position shown in FIG. 1 such that it is urged away from opposing roller segment 30 and waste backing web 14A.

Roller segment 30 is rotatable about an axis which is fixed relative to peel plate 20. In the embodiment shown, roller segment 30 is spring biased to rotate in an anti-clockwise direction toward a starting position as shown in FIG. 1. A stop means (not shown) may be provided to limit rotation in this direction to the starting position.

In use, the drive mechanism (including drive roller 28 and opposing roller segment 30) operates in a first mode to apply a driving force to web 14 and in a second mode to apply a take-up force. The driving force is greater than the peeling threshold whilst the take-up force is less than the peeling threshold.

As surface 16 of product 18 is brought into contact with drive roller 28, roller 28 is pushed upward along elongate slot 36 against the spring bias. In that position waste portion 14A of web 14 is gripped between drive roller 28 and opposing roller segment 30.

In the first mode of operation, movement of product 18 to the right (as shown in FIG. 1) rotates drive roller 28 anti-clockwise and opposing roller segment 30 clock-wise as shown. Web 14 is therefore pulled, with a force exceeding the peeling threshold, around edge 22 of peel plate 20 so as to initiate dispensing of label 12A toward surface 16 and rub-down roller 24.

This action must continue at least until the leading edge of label 12A reaches pinch point 26, between rub-down roller 24 and surface 16, where it is pressed onto surface 16 to be adhered thereto. Roller segment 30 is therefore required to draw waste portion 14A of backing web 14 for a sufficient distance to enable leading edge of the label 12A to reach pinch point 26. The arc of contact 32 of roller segment 30 should therefore be at least equal to or greater than the predetermined distance, to be spanned by an initial portion of label 12A, between edge 22 and pinch point 26.

Once the leading edge of label 12A is adhered to surface 16 it then assists dispensing of the label by providing an additional force along web 14. From that point in the cycle onwards, the driving force provided by drive roller 28 and opposing roller segment 30 is no longer required. This is because the additional 5 force arising from adhesion of label 12A to surface 16 serves to keep the peeling force on web 14 above the peeling threshold. Label 12A therefore continues to be dispensed by being pulled from backing web 14 by movement of label applicator 10 across surface 16.

When roller segment 30 reaches the end of its arc of contact 32 the drive mechanism enters the second mode of operation as depicted in FIG. 2. In this mode, the trailing edge of roller segment 30 pushes backing web 14A against drive roller 28 with a force determined by its spring bias. Friction between drive roller 28 and web 14 produces a take-up force or tension on web 14 which is sufficient to take-up slack in backing web 14. This take-up force remains present for the remainder of the dispensing cycle.

Once label 12A is fully separated from backing web 14, web 14 may continue to be pulled around edge 22 whilst the final portion of label 12A is pressed against surface 16 by rub-down roller 24. However, when the next label 12B (refer FIG. 2) reaches edge 22, the take-up force, being below the peeling threshold, will not be sufficient to initiate dispensing of that label 12B. From that point onwards, drive roller 28 will slip against web 14A. The take-up force is thus predominantly determined by the friction characteristics of the interface between drive roller 28 and web 14A and by the radial force produced against the back of web 14A by the trailing edge of roller segment 30 through the action of its spring bias.

After label 12A is fully adhered to surface 16, applicator 10 either passes over the left hand end of product 18 (as viewed in FIG. 2) or is lifted from product 18. This allows the spring bias on drive roller 28 to return that roller to the lower starting position, thereby releasing opposing roller segment 30 and allowing its rotational spring bias to return it to the starting position shown in FIG. 1 Applicator 10 is thereby reset and is ready to apply the next label 12B.

Depending on the purpose to which applicator 10 is to be put, waste backing web 14A may be allowed to merely fail to the floor (e.g. in a hand operated model) or it may be collected on a pick-up spool (not shown). In one advantageous development of the embodiment shown in FIGS. 1 and 2, a pick-up spool may be driven via a belt from rub-down roller 24. The pick-up spool may be provided with an adjustable clutch allowing its tension to be varied so that total pick-up force on waste web 14A remains below the peeling threshold.

Further developments may be included to facilitate high speed operation in an industrial environment and such developments are considered to be within the spirit and scope of the invention.

Figure 3:
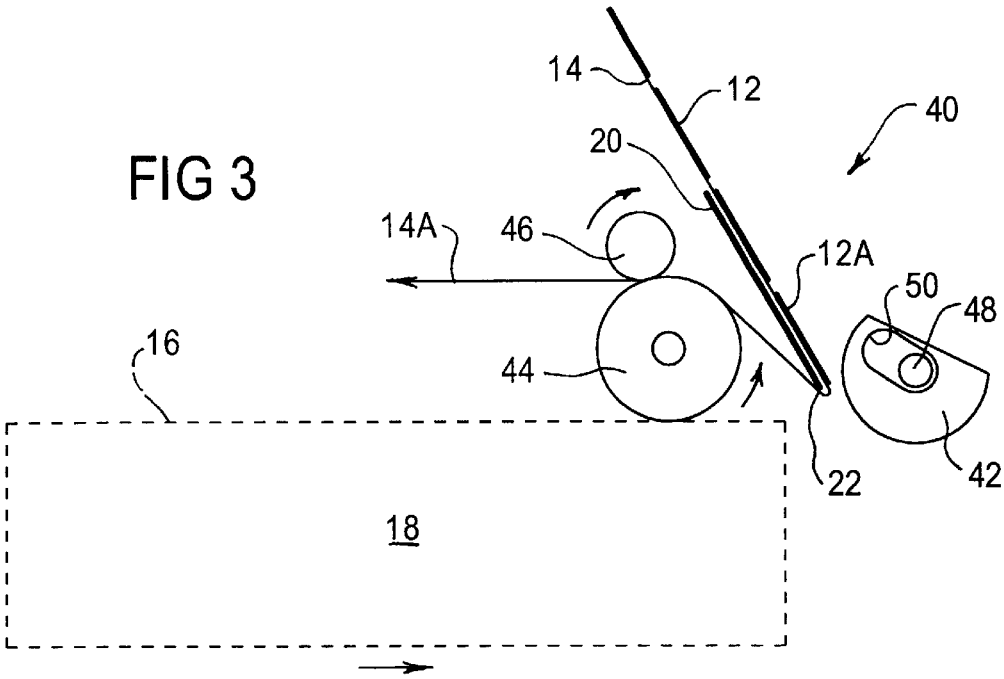
FIG. 3 shows a cross-sectional side view of a label applicator according to a second preferred embodiment of the invention, prior to commencement of a label application cycle.
Figure 4:
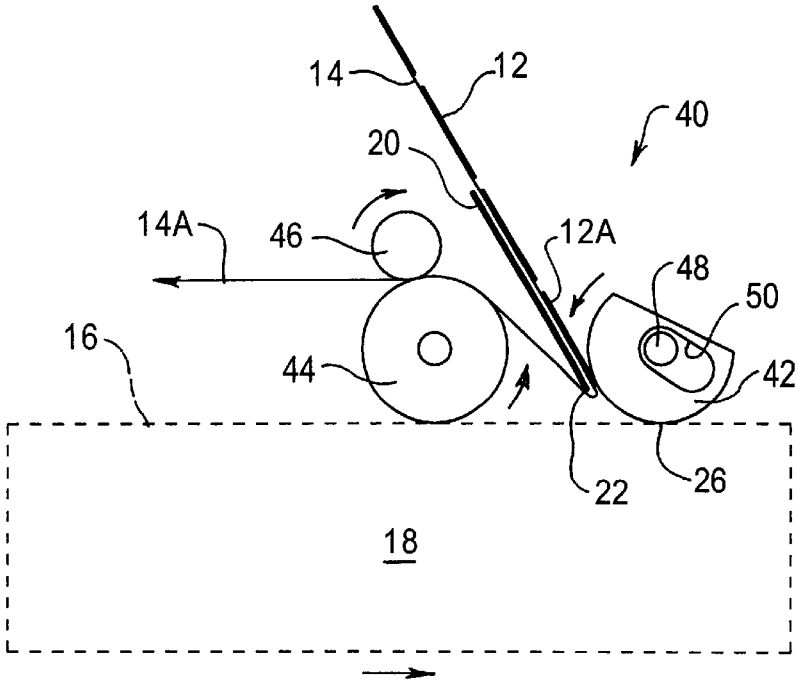
FIGS. 4 and 5 show cross-sectional side views of the label applicator of FIG. 3 during the label application cycle.
Figure 5:
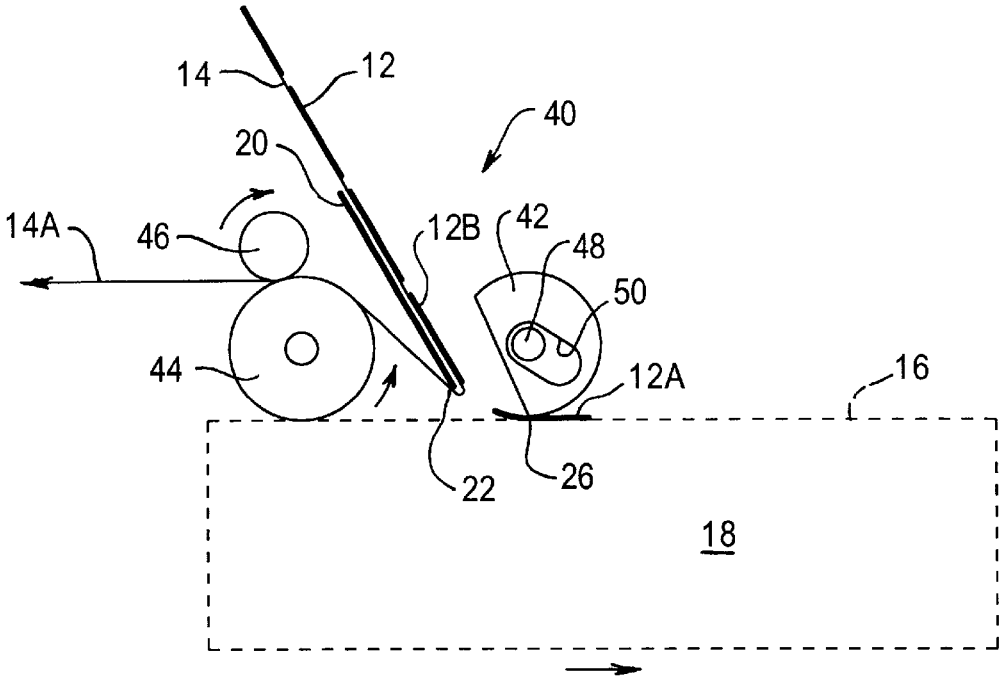

Turning now to FIGS. 3 to 5, there is shown a second preferred embodiment of a label applicator 40 of the invention. Similar reference numerals are used in FIGS. 3 to 5 to denote similar components shown in FIGS. 1 and 2. FIG. 3 shows applicator 40 prior to commencement of a label application cycle, FIGS. 4 shows applicator 40 in contact with a product 18 to be labelled and FIG. 5 shows applicator 40 during the application cycle.

Similar to the first embodiment shown in FIGS. 1 and 2, applicator 40 is used to apply self-adhesive labels 12 provided on an elongate backing web 14. A label 12A is to be applied to surface 16 of product 18 which is being carried along a conveyor belt (not shown) from left to right, as depicted in FIGS. 3–5, below stationary applicator 40. Alternatively, product 18 may be stationary and applicator 40 may be moving.

Applicator 40 includes a peel plate 20 having a lower edge 22 about which web 14 is drawn, with a peeling force exceeding a peeling threshold, to dispense label 12A. Pressing means is provided in the form of a roller segment 42 which forms with surface 16 a pinch point 26 (refer FIGS. 4 and 5) to press label 12A against surface 16. Pinch point 26 is a set distance from edge 22, in a manner similar to the first embodiment described above.

Take-up means are provided to take-up the peeled away or waste backing web 14A. The take-up means includes a take-up roller 44 and an opposing pressure roller 46, each of which rotates about an axis which is held in a fixed position relative to peel plate 20. Rollers. 44 and 46 together apply to waste web 14A a take-up force which is below the peeling threshold. In use, take-up roller 44 contacts surface 16 and is driven by movement of surface-16 relative to applicator 40. Because the take-up force is below the peeling threshold, it is insufficient by itself to initiate dispensing of label 12A.

Roller segment 42 is rotatably supported by axle members 48 fixed to and projecting from its ends. Axle members 48 are carried in elongate slots 50 provided within a frame or structure of applicator 40, and can therefore slide within slots 50 to enable roller segment 42 to move toward and away from label 12A attached to web 14 positioned on peel plate 20. Roller segment 42 is spring biased towards the lower position shown in FIG. 3 such that it is urged away from label 12A. Roller segment 42 is also spring biased in a clockwise direction to a starting position as shown in FIG. 3. A stop means (not shown) may be provided to limit rotation in that direction to the starting position.

In use, applicator 40 engages surface 16 as shown in FIG. 4. Roller segment 42 moves upward along slot 50 so as to contact the face of label 12A. Relative movement between applicator 40 and surface 16 drives take-up roller 44 and roller segment 42 in an anti-clockwise direction as shown in FIG. 4. Friction between roller segment 42 and the face of label 12A produces a supplemental force along web 14. The take-up force and the supplemental force together exceed the peeling threshold to initiate dispensing of label 12A.

The supplemental force continues to be applied at least until the leading edge of label 12A reaches pinch point 26 where it is adhered to surface 16. Roller segment 42 should apply the supplemental force for a sufficient part of the cycle to enable an initial portion of label 12A to span the predetermined distance between edge 22 and pinch point 26.

Once the leading edge of label 12A is adhered to surface 16 it then assists dispensing of the label by providing an additional force along web 14. From that point in the cycle onwards, the supplemental force is no longer required because the additional force serves to keep the total force on web 14 above the peeling threshold.

As the label application cycle continues; roller segment 42 continues to rotate until it reaches a position as shown in FIG. 5. A stop means (not shown) may be provided to limit rotation to that position. The trailing edge of roller segment 42 then defines pinch point 26 such that label 12A is then rubbed against surface 16.

Once the label 12A is fully separated from backing web 14, as shown in FIG. 5, web 14 may continue to be pulled around edge 22 by take-up roller 44, whilst the final portion of label 12A is being rubbed against surface 16 by roller segment 42. When the next label 12B reaches edge 22, the take-up force, being below the peeling threshold, will not be sufficient to initiate dispensing of the next label 12B. Beyond that point, take-up roller 44 will slip against web 14A.

Upon completion of a label application cycle product 18 passes from applicator 40. The translational and rotational spring biases on roller segment 42 then return that roller segment 42 to its starting position as shown in FIG. 3. Applicator 40 is thereby reset and is ready to apply the next label 12B.

Finally, it is to be understood that various alterations, modifications and/or additions may be introduced into the constructions and arrangements of parts previously described without departing from the spirit or ambit of the invention.

What is claimed is:

1. Apparatus for applying a self-adhesive label to a surface which is movable relative to said apparatus, said label being carried on an elongate backing web having a plurality of labels adhered to one side thereof in longitudinally spaced relationship, said apparatus including:

an edge over which said web is drawn whereby, when a force is applied along said web which exceeds a peeling threshold, said web is peeled away from said label and said label is dispensed at said edge;

pressing means located a set distance from said edge for pressing said label against said surface as it is dispensed, thereby adhering said label to said surface; and means for applying a peeling force which is greater than said peeling threshold during dispensing of at least an initial portion of said label which spans said set distance to initiate dispensing of said label, said peeling force being operative during dispensing of said initial portion of said label and being inoperative during dispensing of a final portion of said label, wherein when said peeling force is inoperative, dispensing is continued due to an additional force being exerted along said web by a portion of said label which is adhered to said surface.

2. Apparatus according to claim 1 wherein said peeling force is a single force applied to said web, said force being sufficient to initiate dispensing of said label.

3. Apparatus according to claim 1 wherein said peeling force is a combination of several forces acting together, said forces being sufficient to initiate dispensing of said label.

4. Apparatus according to claim 1 including means for applying a take-up force, said take-up force being below said peeling threshold, and being provided during at least a part of said dispensing cycle for taking up said peeled backing web from said edge.

5. Apparatus according to claim 4 wherein said means for applying said peeling force includes said means for applying said take-up force.

6. Apparatus according to claim 4 where said take-up force forms part of said peeling force.

7. Apparatus for applying a self-adhesive label to a surface which is movable relative to said apparatus, said label being carried on an elongate backing web having a plurality of labels adhered to one side thereof in longitudinally spaced relationship, said apparatus including:

an edge over which said web is drawn whereby, when a force is applied along said web which exceeds a peeling threshold, said web is peeled away from said label and said label is dispensed at said edge;

pressing means located a set distance from said edge for pressing said label against said surface as it is dispensed, thereby adhering said label to said surface; and means for applying, in a first mode, a driving force and, in a second mode, a take-up force along said backing web, said driving force being greater than said peeling threshold to initiate dispensing of said label, said driving force being operative over at least an initial portion of said label which spans said set distance and being inoperative over a final portion of said label, said take-up force being below said peeling threshold and being sufficient to take up said peeled backing web from said edge, and wherein, during dispensing of said final portion of said label when said driving force is inoperative, movement relative to said apparatus of said surface and a portion of said label which is adhered thereto provides an additional force along said backing web, said take-up and additional forces together exceeding said peeling threshold to continue dispensing of said label.

8. Apparatus according to claim 7 wherein said driving force and take-up force are both applied to said peeled or waste portion of said backing web leaving said edge at which said label is dispensed, so that each force acts to pull said web around said edge.

9. Apparatus according to claim 7 wherein during dispensing of said final portion of said label, said additional force arising from said label itself being partially adhered to said surface, acts to pull said web toward said dispensing edge.

10. Apparatus according to claim 9 wherein said additional force is sufficient to exceed said peeling threshold.

11. Apparatus according to claim 9 wherein said additional force acts in conjunction with said take-up force to exceed said peeling threshold.

12. Apparatus for applying a self-adhesive label to a surface which is movable relative to said apparatus, said label being carried on an elongate backing web having a plurality of labels adhered to one side thereof in longitudinally spaced relationship, said apparatus including:

an edge over which said web is drawn whereby, when a force is applied along said web which exceeds a peeling threshold, said web is peeled away from said label and said label is dispensed at said edge;

take-up means for taking up said peeled backing web from said edge, said take-up means being adapted to apply a take-up force to said web which is below said peeling threshold;

pressing means located a set distance from said edge for pressing said label against said surface as it is dispensed, thereby adhering said label to said surface; and means for applying a supplemental force along said backing web to supplement said take-up force, said take-up and supplemental forces together exceeding said peeling threshold to initiate dispensing of said label, said supplemental force being operative over at least an initial portion of said label which spans said set distance and being inoperative over a final portion of said label, and wherein, during dispensing of said final portion of said label when said supplemental force is inoperative, movement relative to said apparatus of said surface and a portion of said label which is adhered thereto provides an additional force along said backing web, said take-up and additional forces together exceeding said peeling threshold to continue dispensing of said label.

13. Apparatus according to claim 12 wherein said take-up force is present throughout a dispensing cycle.

14. Apparatus according to claim 12 wherein said supplemental force is applied to initiate dispensing of said label.

15. Apparatus according to claim 12 wherein said take-up force is applied to said peeled or waste portion of said backing web leaving said edge at which said label is dispensed, to assist in pulling said web around said edge, but not being sufficient by itself to dispense said label.

16. Apparatus according to claim 12 wherein said supplemental force is applied to a portion of said web approaching said dispensing edge.

17. Apparatus according to claim 12 wherein said supplemental force is applied to a front face of said label being dispensed, such that said label and web are pushed toward said dispensing edge, at least during dispensing of said initial portion of the label.

* * * * *